US006916300B2

(12) United States Patent
Hester et al.

(10) Patent No.: US 6,916,300 B2
(45) Date of Patent: Jul. 12, 2005

(54) SEAT MASSAGER

(75) Inventors: Russell D. Hester, Odenton, MD (US); Alan S. Romack, Columbia, MD (US); Keith R. Berning, Jessup, MD (US); Thomas G. Marsden, Eldersburg, MD (US); Rosa Korobkov, Timonium, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 278 days.

(21) Appl. No.: 10/294,245

(22) Filed: Nov. 14, 2002

(65) Prior Publication Data

US 2004/0097854 A1 May 20, 2004

(51) Int. Cl.[7] ..... A61H 23/04

(52) U.S. Cl. ..... 601/149; 148/150; 297/284.6

(58) Field of Search ..... 601/148, 149, 601/150, 151, 152; 128/DIG. 20; 602/13; 297/284.1, 284.3, 284.4, 284.6, 452.41; 5/615, 710, 644, 713

(56) References Cited

U.S. PATENT DOCUMENTS

| | | | | |
|---|---|---|---|---|
| 1,147,560 A | | 7/1915 | Shurtleff | |
| 2,528,843 A | | 11/1950 | Poor | 128/24 |
| 2,531,074 A | | 11/1950 | Miler | 128/38 |
| 2,819,712 A | | 1/1958 | Morrison | 128/33 |
| 3,148,391 A | | 9/1964 | Whitney | 5/348 |
| 3,196,868 A | | 7/1965 | Johnston | 128/57 |
| 3,326,601 A | | 6/1967 | Vanderblt | 297/284 |
| 3,390,674 A | * | 7/1968 | Jones | 601/150 |
| 3,477,071 A | | 11/1969 | Emerson | 5/61 |
| 3,672,360 A | | 6/1972 | Langhammer | 128/67 |
| 3,760,801 A | | 9/1973 | Borgeas | 128/25 |
| 3,770,315 A | | 11/1973 | Smittle et al. | 297/284 |
| 3,993,053 A | | 11/1976 | Grossan | 128/64 |
| 4,175,297 A | | 11/1979 | Robbins et al. | 5/284 |
| 4,178,923 A | | 12/1979 | Curlee | 128/78 |
| 4,524,762 A | | 6/1985 | Schulman | 128/33 |
| 4,634,179 A | | 1/1987 | Hashimoto et al. | 297/284 |
| 4,703,750 A | | 11/1987 | Sebastian et al. | 128/78 |
| 4,707,027 A | | 11/1987 | Horvath et al. | 297/284 |
| 4,833,614 A | | 5/1989 | Saitoh et al. | 364/323.05 |
| 4,981,131 A | | 1/1991 | Hazard | 128/38 |
| 4,986,260 A | | 1/1991 | Iams et al. | 128/24 |
| 5,029,939 A | | 7/1991 | Smith et al. | 297/284 |
| 5,103,808 A | | 4/1992 | Iams et al. | 128/52 |

(Continued)

*Primary Examiner*—Gregory L. Huson
*Assistant Examiner*—Quang D. Thanh
(74) *Attorney, Agent, or Firm*—Larry J. Guffey

(57) ABSTRACT

A seat massager for massaging a person's back has, according to the present invention, a pair of inflatable, massage bladders configured so as to be received in close proximity to a person's back and oriented so that these bladders share an overlaid portion with each other, a pump that supplies fluid to the bladders, a fluidic having an inlet and two exhaust ports, a conduit that connects each of the fluidic exhaust ports to one of the pair of bladders, wherein the fluidic is configured so as to yield alternating flow from the exhaust ports that cyclically inflates and deflates each of the bladders so as to provide a massaging sensation to the back. This massager may also include an inflatable support bladder positioned beneath the massage bladders, another pump that supplies fluid to this support bladder, and a carrier plate on which the pumps are mounted, this plate being configured so as to aid in attaching the seat massager to the frame of a seat into which the seat massager is to be installed.

29 Claims, 20 Drawing Sheets

U.S. PATENT DOCUMENTS

| | | | | | |
|---|---|---|---|---|---|
| 5,109,832 | A | | 5/1992 | Proctor et al. | 128/24 |
| 5,135,282 | A | | 8/1992 | Pappers | 297/284 |
| 5,211,162 | A | | 5/1993 | Gillen, Jr. et al. | 128/64 |
| 5,529,573 | A | | 6/1996 | Kelly et al. | 601/34 |
| 5,558,398 | A | | 9/1996 | Santos | 297/284.3 |
| 5,562,604 | A | | 10/1996 | Yablon et al. | 601/148 |
| 5,624,383 | A | | 4/1997 | Hazard et al. | 601/5 |
| 5,637,076 | A | | 6/1997 | Hazard et al. | 601/5 |
| 5,658,050 | A | | 8/1997 | Lorbiecki | 297/452.41 |
| 5,848,982 | A | | 12/1998 | Hoshino et al. | 601/150 |
| 5,906,586 | A | * | 5/1999 | Graham | 602/13 |
| 5,967,608 | A | | 10/1999 | Sickle | 297/284.6 |
| 6,049,748 | A | | 4/2000 | Newman et al. | 701/49 |
| 6,098,000 | A | | 8/2000 | Long et al. | 701/49 |
| 6,159,172 | A | * | 12/2000 | Gray et al. | 601/149 |
| 6,203,105 | B1 | * | 3/2001 | Rhodes, Jr. | 297/284.6 |
| 6,296,617 | B1 | | 10/2001 | Peeler et al. | 601/152 |
| 6,406,445 | B1 | * | 6/2002 | Ben-Nun | 601/152 |
| 6,572,570 | B1 | * | 6/2003 | Burns et al. | 601/148 |
| 2002/0091345 | A1 | | 7/2002 | Hazard | |

* cited by examiner

FIG. 1
PRIOR ART
U.S. PATENT No. 4,707,027
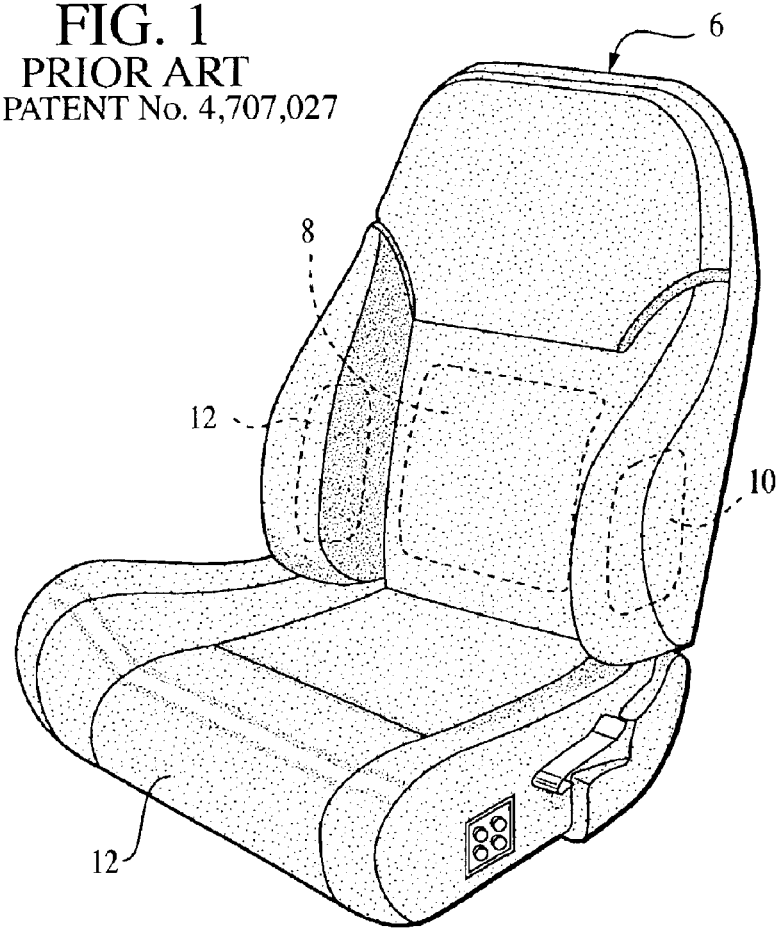
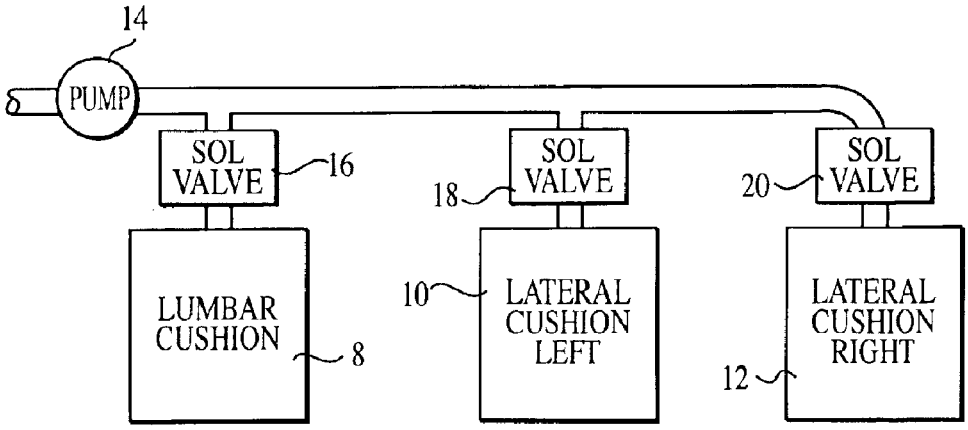
FIG. 2

U.S. PATENT No. 4,981,131

SEAT MASSAGER

CROSS-REFERENCE TO RELATED APPLICATION

This application is related to the following U.S. patent applications:

Ser. No. 09/567,890, filed May 10, 2000, which claims the benefits of Provisional Patent Applications Nos. 60/133,676 filed May 11, 1999, 60/140,744 filed Jun. 25, 1999 and Ser. No. 60/163,154 filed Nov. 2, 1999;

Ser. No. 09/634,591, filed Aug. 8, 2000 but now abandoned, which claimed the benefits of Provisional Patent Application No. 60/147,504 filed Aug. 9, 1999;

Ser. No. 09/713,328, filed Nov. 16, 2000 which claims the benefit of Provisional Patent Application No. 60/167,695 filed Nov. 29, 1999;

Ser. No. 09/773,631, filed Feb. 2, 2001 but now abandoned, which claimed the benefit of Provisional Patent Application No. 60/180,123 filed Feb. 3, 2000, and Ser. No. 09/982,085, filed Oct. 19, 2001, which claims the benefit of Provisional Patent Application No. 60/241,791 filed Oct. 20, 2000.

BACKGROUND OF THE INVENTION

1. Field of the Invention

This invention relates to chairs and seats of the type having the means to alter their contours for the pleasure of one using them. More particularly, this invention relates to methods and apparatus for causing a chair or seat to massage the back or legs of one sitting in them.

2. Description of the Related Art

Discomfort, pain, injuries and diseases involving the back are common. The back consists of a column of bones called vertebrae, which are separated by discs that act as cushions and are held together by muscles and ligaments. A normal healthy back has three natural curves, the upper cervical curve, the thoracic curve and the lower lumbar curve. When these three curves are in normal alignment, a person's body weight is evenly distributed throughout the vertebrae and discs, and when the muscle groups of the back are strong and flexible the person may move freely and without effort. Natural aging, premature aging, misuse, or injury, give rise to certain spinal problems which cause a variety of symptoms, such as stiffness, pain, tingling and numbness. More serious back problems may require corrective surgery, but the majority of back problems respond favorably to non-surgical therapy. Many back problems may be healed by a combination of rest, modalities, medication, or bracing.

Many types of apparatus and methods have heretofore been proposed and developed for alleviating back problems. Because the average person spends a great deal of time sitting, considerable effort has been directed to the design of chairs and seats so as to alleviate any back discomfort that an individual might experience as a result of an extended period of sitting.

Inflatable air bladders have been used in a variety of configurations to provide adjustments to the contour of a seat, and in this manner to enhance the comfort of the individual using the seat. For example, see U.S. Pat. Nos. 3,326,601, 4,707,027, 4,833,614, 5,135,282, 5,558,398, 5,658,050, 5,967,608 and 6,098,000.

Because of the popularity of therapeutic (i.e., having the power to provide comfort from muscular aches and pains) massages for relieving the discomfort from a wide assortment of ailments, it is probably not surprising that many types of massagers, utilizing cyclicable inflatable bladders, have been built into various types of seating. For example, see U.S. Pat. Nos. 3,760,801, 4,175,297, 4,524,762, 4,634,179, 5,211,162 and 5,848,982.

Since "continuous passive motion (CPM)" applied to an injured limb (i.e., repetitiously moving the limb through a range of positions as medically prescribed) has for some time been a common method of rehabilitative treatment, it is probably also not surprising that continuous passive motion devices, also utilizing cyclicable inflatable bladders, have been introduced into chairs and seats. For example, see U.S. Pat. Nos. 4,981,131, 4,986,260, 5,529,573, 5,624,383, 5,637,076 and U.S. Pat. Application Publication No. 2002/0,091,345.

It is notable that CPM devices are distinguished in the patent literature from massagers for their claimed ability to "treat or prevent low back pain" as compared with massagers which are identified as providing "superficial stimulation of the soft tissue." This distinction is said to be attributable to the differences between the amplitudes and frequencies of spinal motions caused by the respective devices. CPM devices are said to provide cyclic spinal mobilization (flexing between adjacent vertebrae sufficient to alter the vertebral discs . . . i.e., to cause lordotic movement), which is reportedly quite different from any "massage effect." The preferred cycle times for CPM devices are noted to be "too slow for any massage effect to occur."

The degree of lordotic movement is said to depend upon the individual person's lumbar compliance, which varies within the population. "Experience has shown that for persons having normal lumbar compliance, displacements on the order of at least about one inch and as much as three inches or more, delivered over a total cycle duration of twenty to thirty seconds (including both inflation and deflation intervals) generally can provide sufficient spinal mobilization to give a beneficial effect . . . Generally a total cycle duration that is too short (on the order, for example, of about five seconds or less) does not permit the spine to respond passively to effect a spinal mobilization, and can be distracting to the user, while a total cycle duration that is too long (on the order, for example, of ten minutes) can result in static conditions between successive inflations and deflations, reducing the effectiveness of the spinal movements." See col. 8, lines 7–24 of U.S. Pat. No. 4,981,131.

More recent inventive contributions in this area have focused on the control systems for such massagers and CPM devices. These have included systems that employ transducers for measuring the forces exerted by the inflated bladders, that control the voltage supply to the electric pumps as a means of regulating the rates at which they inflate any bladders, and that prolong the operating life of the pumps used in these applications. See U.S. Pat. Nos. 5,624,383, 5,637,076 and U.S. Patent Application Publication No. 2002/0,091,345.

In general, FIGS. 1 and 2 from U.S. Pat. No. 4,707,027 display the basic elements of such massagers and CPM devices. These are seen to consist of one or more inflatable bladders, an electric pump and various control valves and conduits which serve to inflate and deflate the bladders. Meanwhile, FIG. 3 from U.S. Pat. No. 4,981,131 displays a typical control system for such massagers and CPM devices. It consists of a timer and timer operated valves that regulate the fluid flow from the pump to the bladders; alternately, certain pumps are available which permit the user to directly set their power levels and their intervals of operation.

Despite much prior art, there still exists a need for further technological improvements in this area. For example, simpler systems are needed which provide lower cost, longer life and more reliable, problem-free operation, plus provide more comfort and enjoyment for those using them. Among some of the problems being experienced by the current apparatus in this area include: excessive pump and air flow noise during their operation, excessive heat buildup in the seat materials surrounding such apparatus, and excessive manpower hours needed to assemble and install the various elements of such apparatus. Additionally, greater pleasure from their use is thought to be available as a result of continued development in the orientation and means of operation for the inflatable bladders of such devices.

3. OBJECTS AND ADVANTAGES

There has been summarized above, rather broadly, the prior art that is related to the present invention in order that the context of the present invention may be better understood and appreciated. In this regard, it is instructive to also consider the objects and advantages of the present invention.

It is an object of the present invention to provide a therapeutic seat massager that is not afflicted with the current, major operational problems of such apparatus, including: excessive pump and air flow noise, excessive heat buildup in the adjoining seat materials, and excessive manpower hours needed to assemble and install such apparatus.

It is another object of the present invention to provide a simpler, therapeutic seat massager having a longer operational life than current models.

It is yet another object of the present invention to provide a therapeutic seat massager which has a greater variety of massaging capabilities than current models.

It is still object of the present invention to provide a therapeutic seat massager which is in the form of a completely assembled package which can easily and quickly be installed into an existing seat.

It is an object of the present invention to provide a lower cost therapeutic seat massager that can be offered as a low cost, seat option on a wide range of automobiles.

These and other objects and advantages of the present invention will become readily apparent as the invention is better understood by reference to the accompanying summary, drawings and the detailed description that follows.

SUMMARY OF THE INVENTION

Recognizing the need for the development of improved massagers, the present invention is generally directed to satisfying the needs set forth above and overcoming the disadvantages identified with prior art devices and methods.

In accordance with the present invention, the foregoing need can be satisfied by providing a generalized apparatus for massaging a specified area of a person. In a preferred embodiment, this apparatus comprises a pair of inflatable, massage bladders configured so as to receive the specified area to be massaged, a means for supplying fluid to the bladders, a fluidic having an inlet and two exhaust ports, with this inlet being connected to the fluid supply means, conduit that connect each of the fluidic exhaust ports to one of the pair of bladders, wherein the fluidic is configured so as to yield alternating flow from the exhaust ports that cyclically inflates and deflates each of the bladders so as to provide a massaging sensation to the specified area.

In a second preferred embodiment, the present invention takes the form of a seat massager for massaging a person's back. It comprises: a pair of inflatable, massage bladders configured so as to be received in close proximity to a person's back, each of said bladders having a front surface, with a portion of said front surfaces being overlayed so as to provide a rolling massage sensation when the bladders are inflated and deflated, a means for supplying fluid to the bladders, a fluidic having an inlet and two exhaust ports, with this inlet being connected to the fluid supply means, a conduit that connects each of the fluidic exhaust ports to one of the pair of bladders, wherein the fluidic is configured so as to yield alternating flow from the exhaust ports that cyclically inflates and deflates each of the bladders so as to provide a massaging sensation to the back. This massager further comprises: an inflatable support bladder positioned beneath a portion of the overlayed rear surfaces of the massage bladders, a means for supplying fluid to this support bladder so as to position the massage bladders in proximity to a person's back, and a carrier plate on which the fluid supply means are mounted, this plate being configured so as to aid in attaching the seat massager to the frame of a seat into which the seat massager is to be installed.

In a preferred embodiment of this seat massager, its fluidic is configured so as to provide alternating flow from the exhaust ports that cycles in the frequency range of 0.1–0.15 cycles/second (Hz). Furthermore, when the means for supplying fluid to the bladders is a pump that supplies pressurized air to the fluidic inlet, the fluidic used in this application is further configured so as to allow greater than 40% of the pressure of the fluid supplied to the fluidic inlet to be realized in the inflatable bladders.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

BRIEF DESCRIPTION OF THE DRAWINGS

FIG. 1, from U.S. Pat. No. 4,707,027, shows a representative example of the orientation of the basic elements of prior art massagers and CPM devices.

FIG. 2, from U.S. Pat. No. 4,707,027, shows a representative example of a means for connecting the basic elements of prior art massagers and CPM devices.

DESCRIPTION OF THE PREFERRED EMBODIMENT

Figure 3:
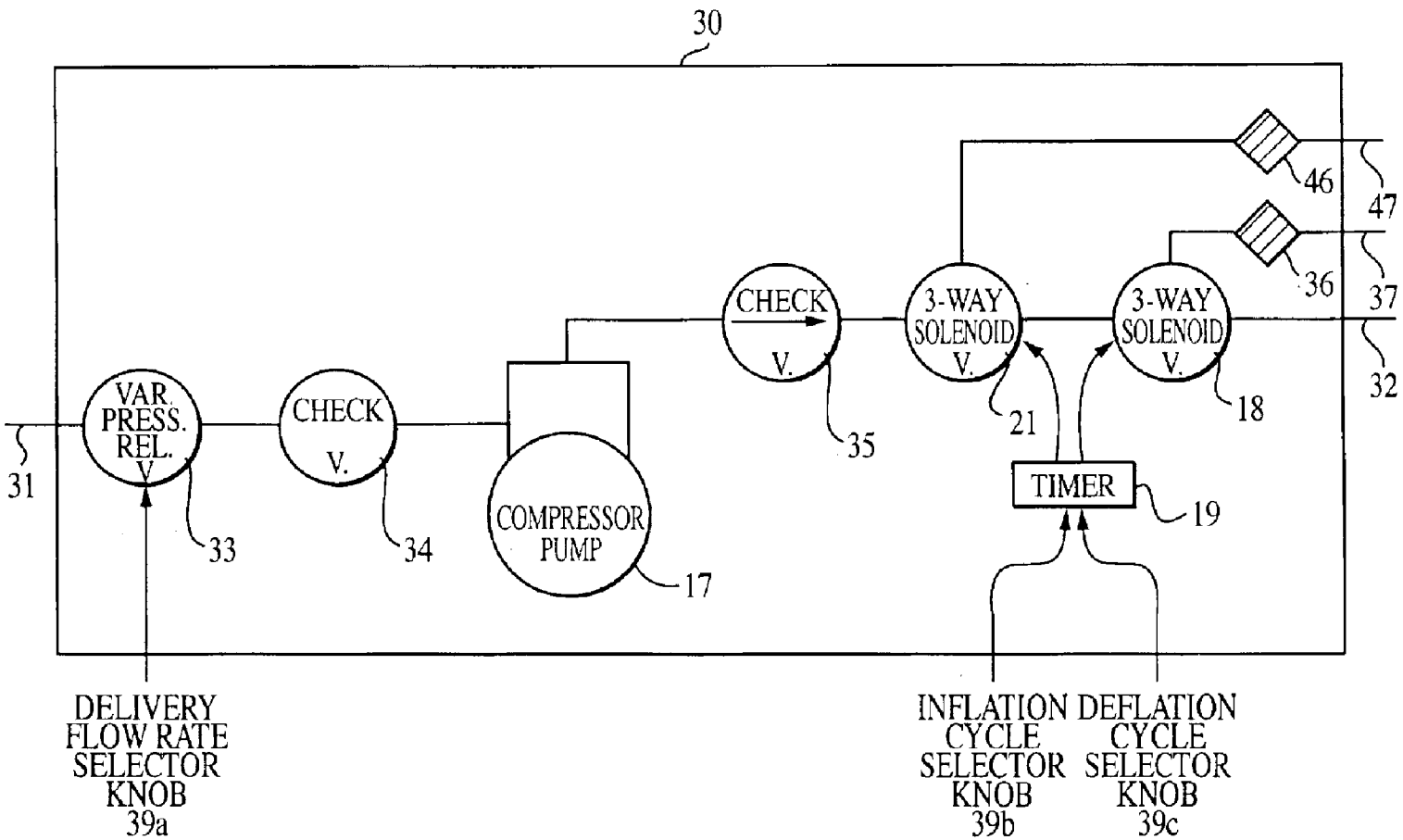
FIG. 3 PRIOR ART
FIG. 3, from U.S. Pat. No. 4,981,131 shows a representative example of a control system for prior art massagers and CPM devices.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. For example, the discussion herein may sometimes refer to "inflatable air bladders;" however, it should be apparent that the inventive concepts described herein are applicable to inflatable bladders containing any type of fluid.

Figure 4:
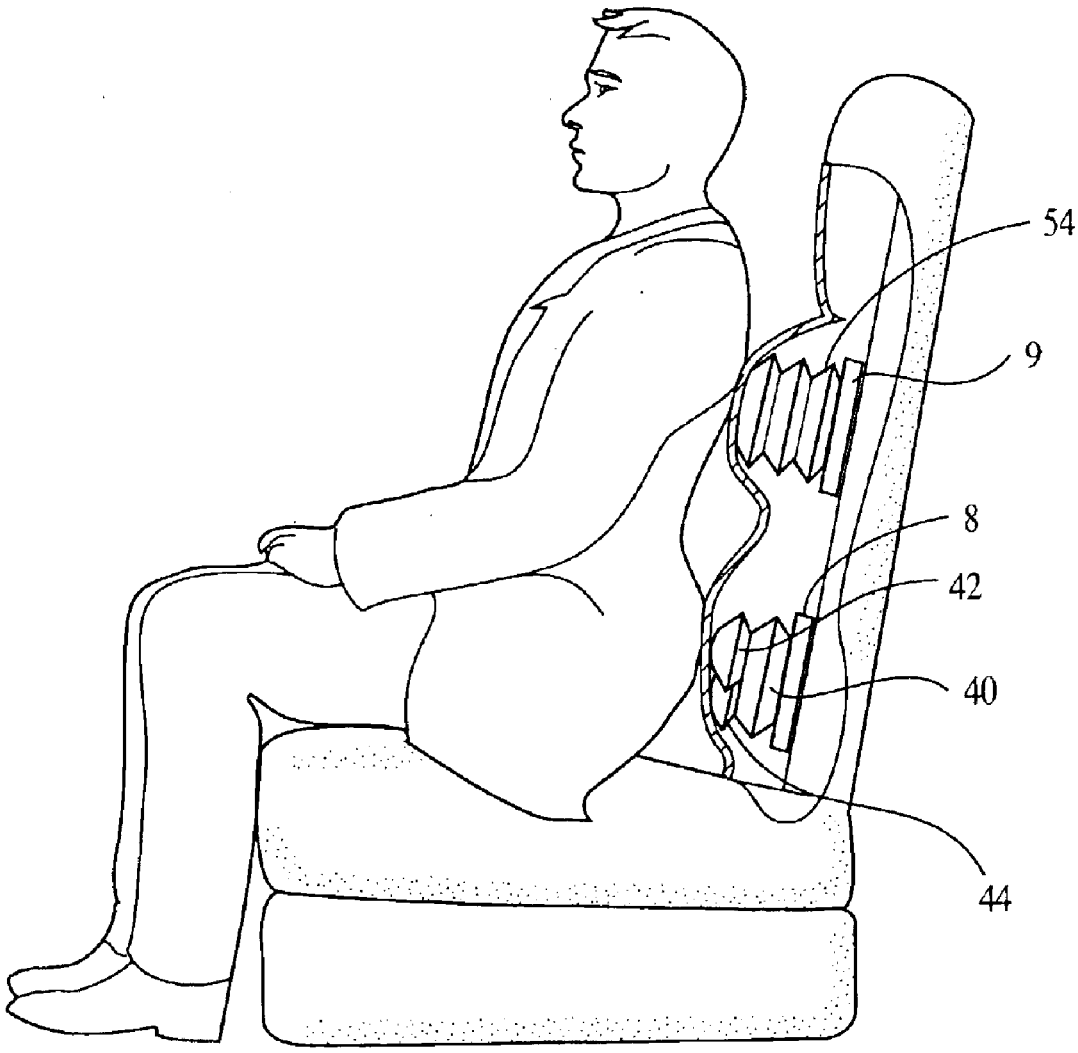
FIG. 4 shows a partial cutaway view of the side of a chair in which inflatable bladders of the present invention are being used to simultaneously massage the upper and lower back regions of one sitting in the chair.

The present invention generally relates to methods and apparatus for causing a portion of a chair or seat, or other body supporting device, to massage a surface area of one who is using them. FIG. 4 shows how this can be accomplished by using an embodiment of the present invention which utilizes inflatable bladders to massage the upper and lower back or lumbar regions of one sitting in a chair.

Figure 5:
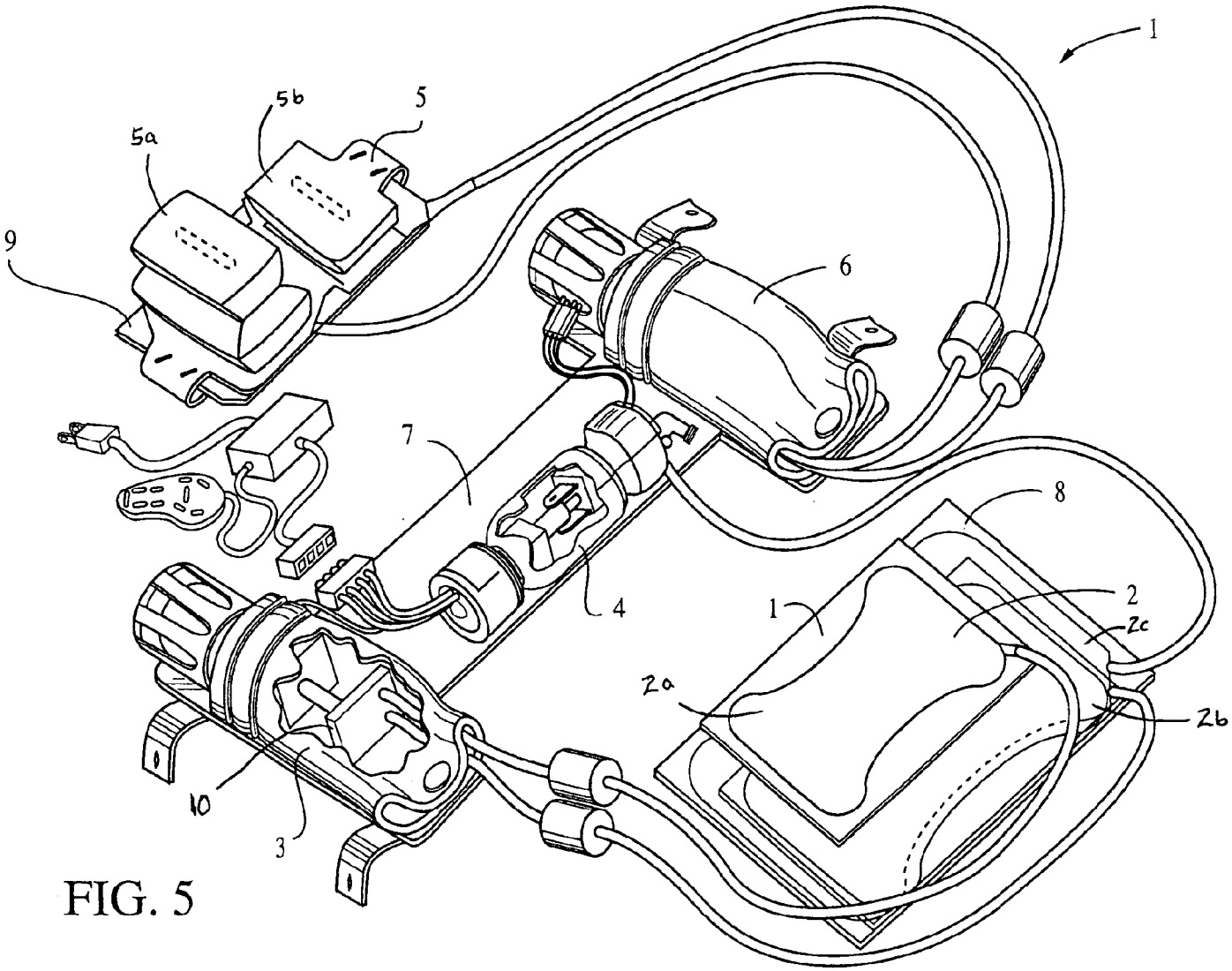
FIG. 5 shows a perspective view of a preferred embodiment of the present invention.

The massager apparatus 1 that performs this task is shown in FIG. 5. It generally consists of a lumbar support and massage package 2 which has a pair of overlapped, inflatable massage bladders 2*a*, 2*b* and an underlying support bladder 2*c*. This package typically also has separate lumbar massage 3 and lumbar support 4 drive systems. It may also have a separate upper back massage package 5 which has adjoining, two-tiered, inflatable massage bladders 5*a*, 5*b*. This package also has its own drive system 6. These drive systems 3, 4, 6 are mounted on a carrier plate 7. Meanwhile, the lumbar and upper back packages are mounted, respectively on lumbar 8 and upper back 9 backer plates.

It is notable that what is not seen in this figure are the timer and timer controlled valves that are found in the prior art and which serve as the means for regulating the operation of such device's inflatable bladders.

An inventive aspect of the present invention is the elimination of these elements by the development of a unique fluidic 10 that serves to alternately direct a pump's output to one or the other of the inflatable bladders that help to comprise the massager elements of the present invention. Like almost all fluidics, the fluidic that has been developed for this application is characterized by the cyclic deflection of a fluid stream without the use of mechanical moving parts. Consequently, this fluidic has the advantage of not being subject to the wear and tear which adversely affects the reliability and operation of timer controlled means for producing cyclic fluid flows.

Another inventive aspect of the apparatus shown in FIG. 5 is the modular nature of this embodiment. This proves to be a very useful quality of the present invention when one wishes to configure this apparatus so that it can be placed in a wide range of seating or bedding devices.

Figure 6:
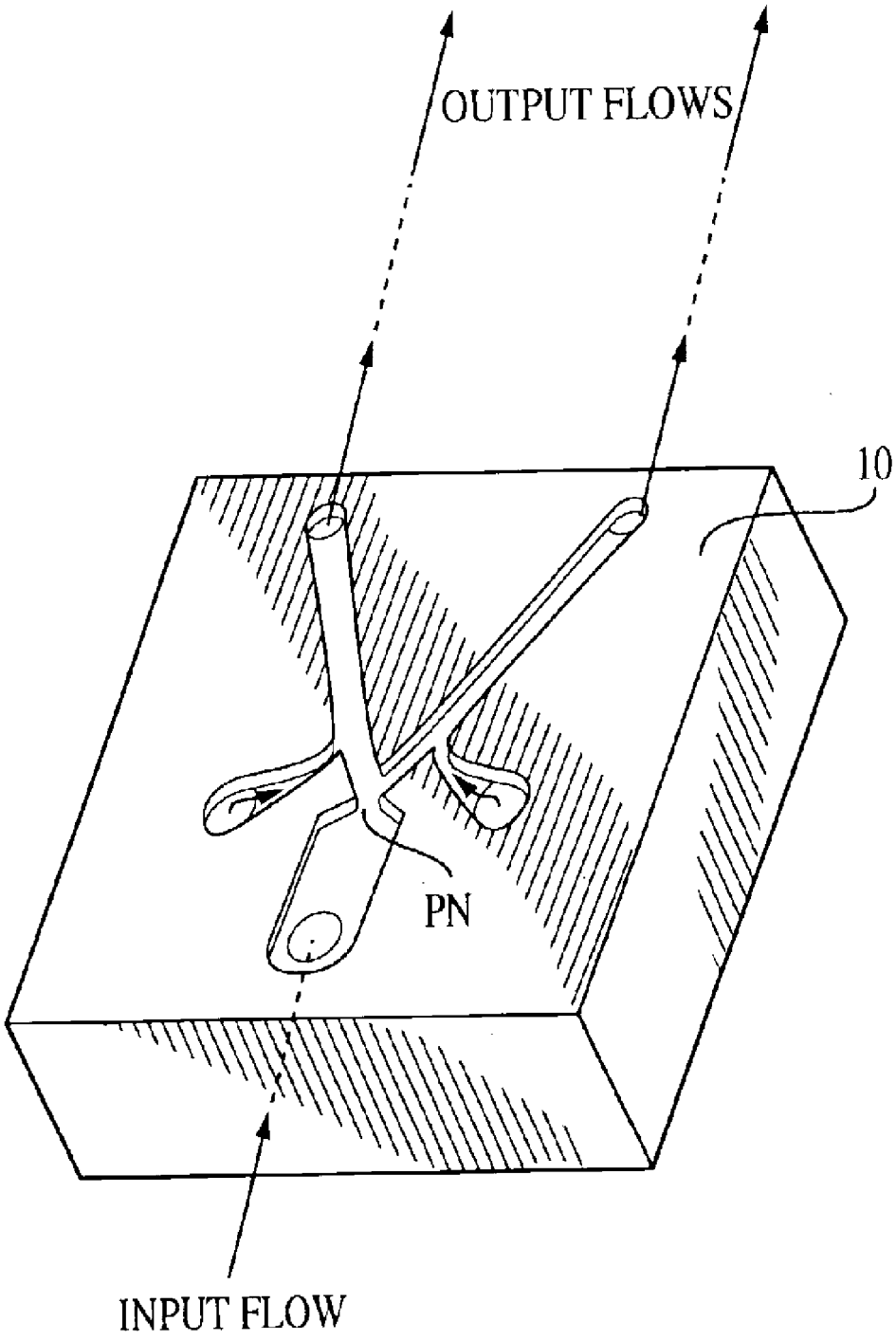
FIG. 6 shows a preferred form of the fluidic for use with the present invention.

FIG. 6 shows the top portion, with the cover plate removed, of the two-dimensional form of a preferred embodiment for the fluidic used in the present invention. This fluidic may be characterized as a backload-responsive (i.e., it switches the direction of the flow in response to the backload pressure that is built up in the inflatable bladder into which it is directing fluid) fluidic that yields high pressure recovery (i.e., greater than 40% of the supply line pressure can be realized in the inflatable bladders).

Figure 7:
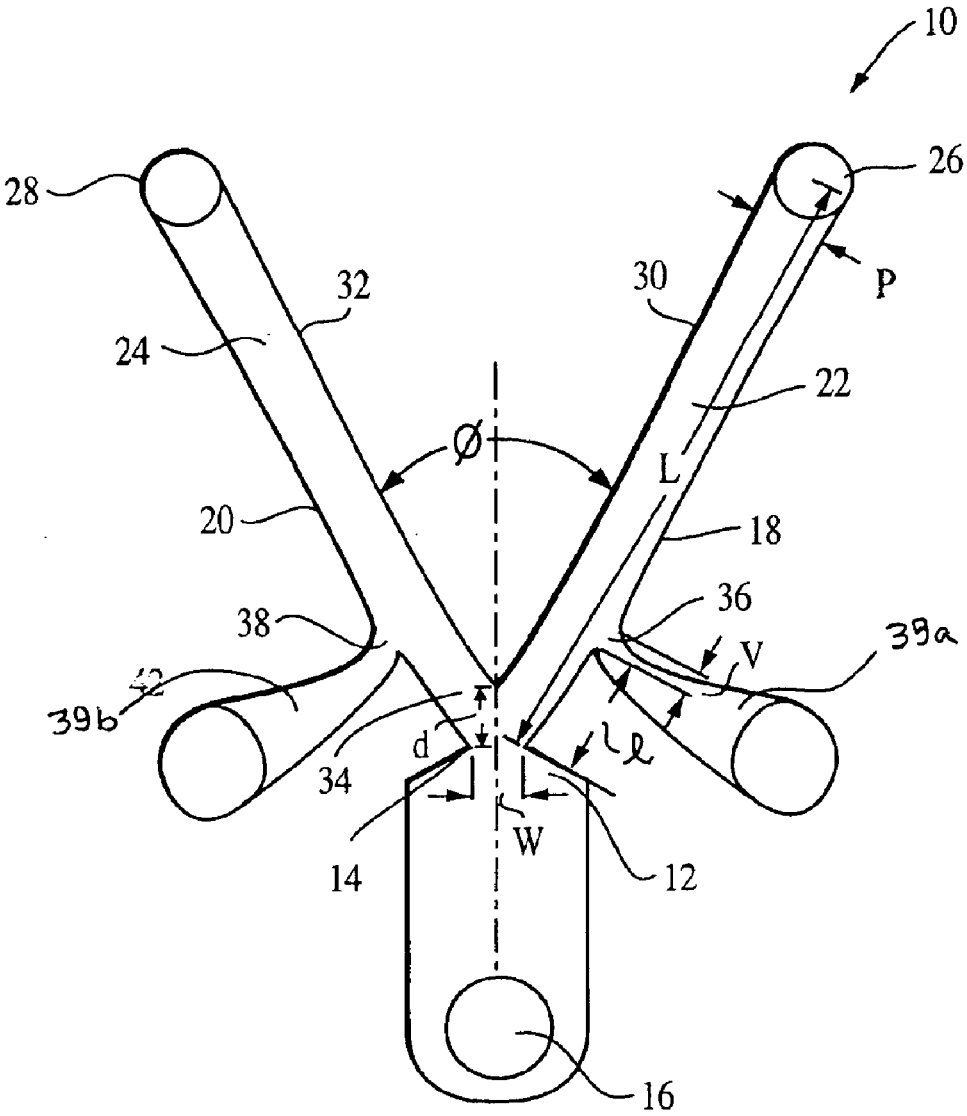
FIG. 7 shows the critical geometric details of the fluidic shown in FIG. 6.

The detailed geometry of this fluidic is shown in FIG. 7. It consists of a power nozzle 12 having a throat 14 whose width is denoted as w. An inlet 16 serves to supply pressurized air to the power nozzle. The edges of the power nozzle throat connect to the right 18 and left 20 outside walls of respective right 22 and left 24 exhaust passages of length L and diameter p that have ends 26, 28 to which are connected conduits that are connected to inflatable bladders. The inside walls 30, 32 of these passages 22, 24 converge at an angle $\phi$ to the point 34 that is a specified distance, d, downstream of the power nozzle's throat. Just downstream and a distance 1 from the power nozzle's throat, there exists a port 36, 38 of initial diameter v in each of the passages' 22, 24 outside walls 18, 20. These ports connect to venting passages 39*a*, 39*b* through which outside air can be entrained into the fluidic or through which air can exit the fluidic during the time when a bladder is being deflated.

In the design of this fluidic it was found that to maximize the fluidic's pressure recovery, the ports 36, 38 should be located as close as possible to the power nozzle's throat. Typical key dimensions for a preferred embodiment of this fluidic are: w=0.02 inches, d=0.06 inches, l=0.06 inches, $\phi$=20 degrees, v=0.02 inches, p=0.04 inches and L=0.75–1.0 inches.

Figure 8:
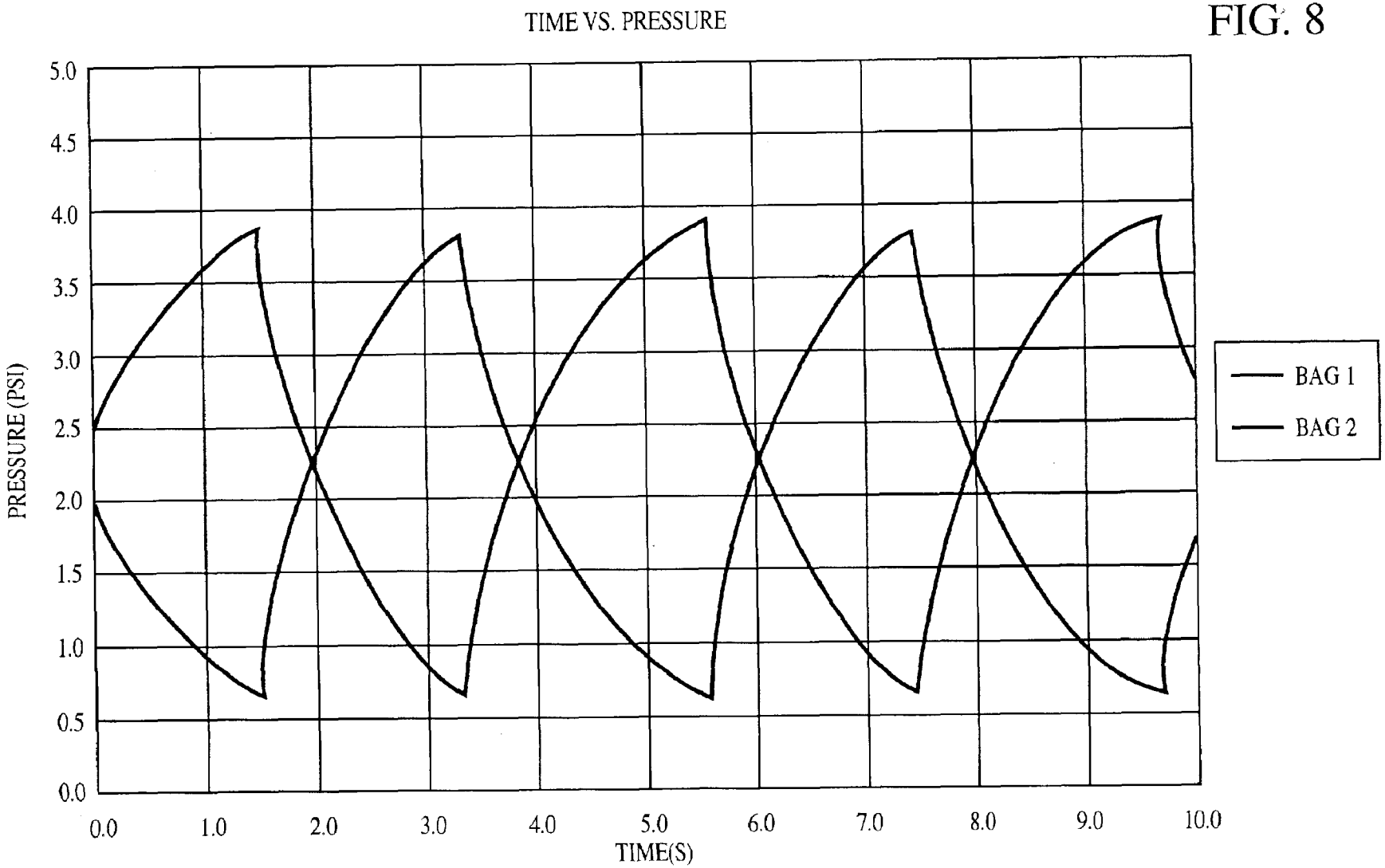
FIG. 8 shows the temporal variations of the pressure being supplied to a pair of massage bladders of the present invention.

For a fluidic sized in this manner, FIG. 8 shows the temporal variations in the pressures measured in each of the inflatable bags that were attached by conduits to the ends of the fluidic's exhaust passages.

To understand the manner of construction of the massager apparatus 1 shown in FIG. 5, one needs to examine the various packages or subsystems that comprise this massager.

Figure 9:
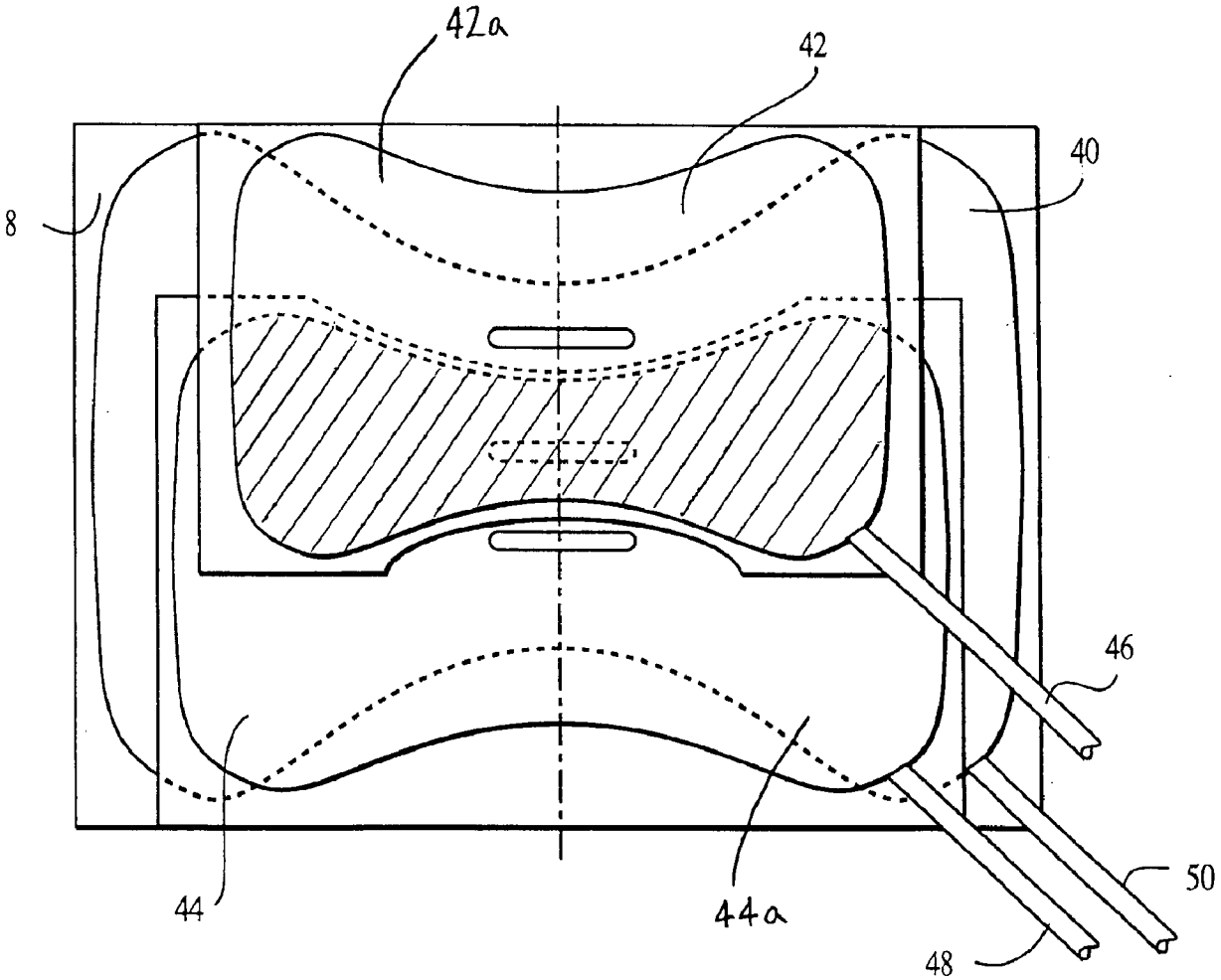
FIG. 9 shows a front view of a preferred embodiment of the lumbar support and massage bladders of the present invention.

FIG. 9 shows the lumbar support and massager package 2. It consists of a lumbar support bladder 40 which is mounted on a lumbar backer plate 8 which serves as a means of fastening this system to a position within a seat in which the massager is to be installed. On top of the lumbar support bladder 40 are mounted an upper 42 and a lower 44 massage bladder. These are mounted so that a portion of the front surface 42*a* of the upper bladder 42 lies above a portion of the front surface 44*a* of the lower massage bladder 44 (e.g., this overlap area is denoted by the hatched markings in FIG. 9). This arrangement has been found to be useful in facilitating a massaging sensation in one who uses the present invention. The massage bladders 42, 44 are connected to the exhaust ports of a fluidic by conduits 46, 48, while the lumbar support bladder 40 is connected by a conduit 50 to a solenoid valve which is connected to the pump which supplies the air to inflate the lumbar support bladder.

The lumbar backer plate 8 also proves to be very useful in fixing the relative positions of the bladders as they are being inflated and deflated. This proves to be important for controlling the massage process such that the tactile sensations the massager imparts to a user will be perceived as pleasurable.

Figure 10A:
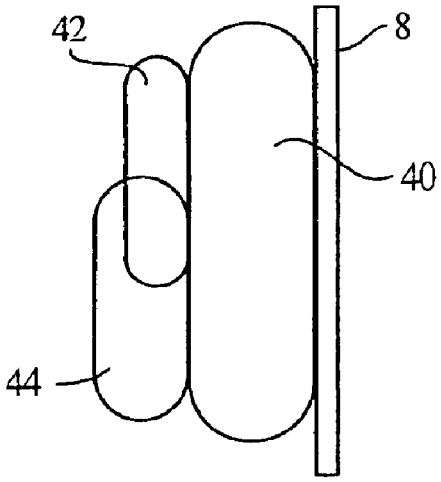
FIGS. 10(*a*)–(*c*) show a side view of the bladders shown in FIG. 9 at different instances in which their degrees of inflation or deflation are different.
Figure 10B:
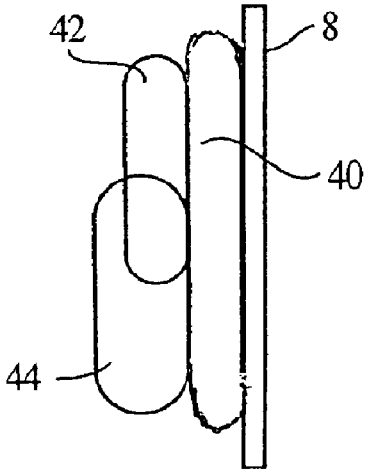
Figure 10C:
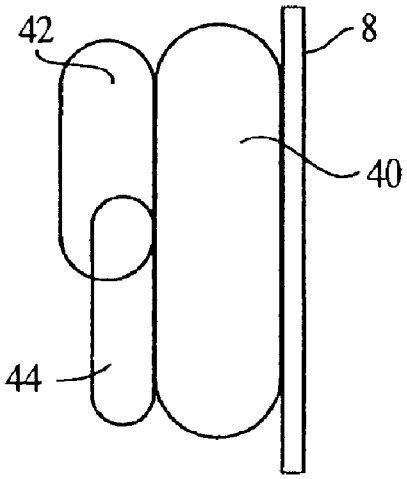

This overlayment of the massage bladders 42, 44 on top of the lumbar support bladder 40 is helpful in allowing this system to provide some unique massage sensations. For example, FIGS. 10(*a*)–(*c*) demonstrate some of the possible bladder inflation stages, and therefore massage sensations, that may be realized with such a system. FIGS. 10(*a*) and 10(*b*) show how the inflation level of the lumbar support bladder 40 can be changed so as to provide maximum support for the lumbar region, while also positioning the massage bladders so that their inflation-deflation cycling will be most effective at providing a comforting massage. FIGS. 10(*a*) and 10(*c*) show the lumbar support bladder 40 at full inflation and with the top 42 and bottom 44 massage bladders being deflated and inflated, respectively, in FIG. 10(*a*), whereas in FIG. 10(*c*) these conditions of the massage bladders are reversed.

The shapes of these bladders are seen to be somewhat elongated and to take a dog-bone-like form. They are pliable and substantially air tight, so that they inflate when air is delivered into them, and can be collapsed when air is permitted to flow out of them. These bladders' are preferably constructed of a flexible plastic sheet material such as a flexible polyurethane according to methods well known in the polymer art. Preferably the bladder material does not stretch substantially under tensions created when the bladder is at maximum inflation.

Typical pressures within the massage bladders and their corresponding inflation times are shown below, where it is assumed that a pump is operated by a control system having three setting levels and is used to inflate the bladders using the fluidic shown in FIGS. 6–7.

| Setting | Max. Pressure (psi) | Min. Pressure (psi) | Inflate Time (sec) |
|---|---|---|---|
| Low | 1.2 | 0.65 | 4.2 |
| Med | 2.1 | 0.80 | 5.4 |
| High | 3.7 | 0.95 | 6.5 |

In a preferred embodiment, the shape of this fluidic is configured such that it yields the bladder pressures indicated above over a frequency range of 0.1–0.15 cycles/second. Other fluidics designs can yield broader frequency ranges, on the order of 0.001–2 cycles/second.

Figure 11:
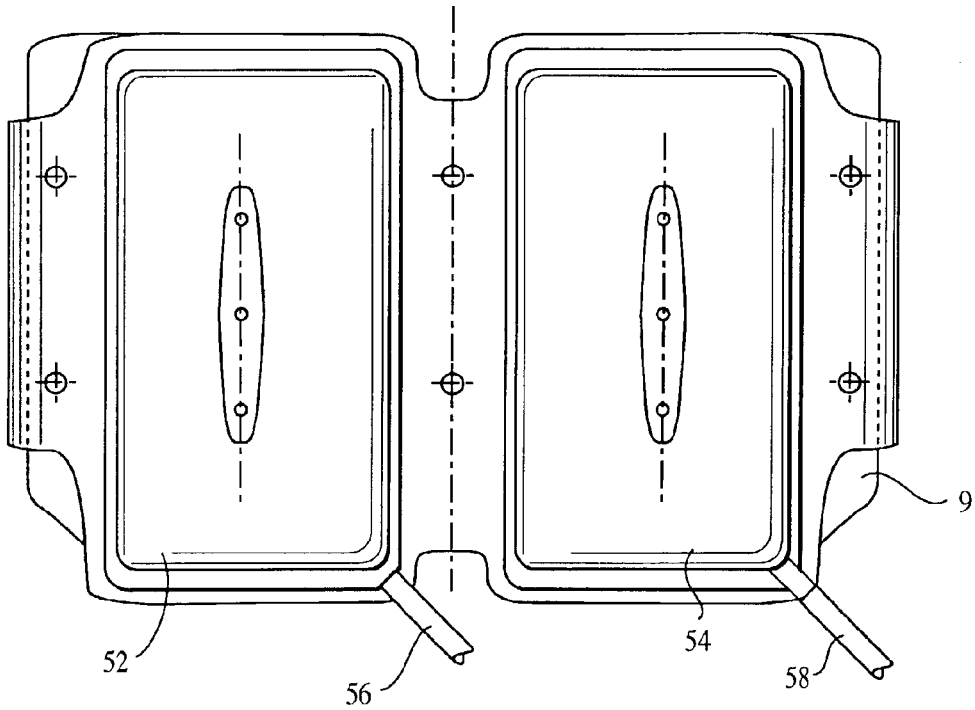
FIG. 11 shows a front view of a preferred embodiment of the upper back massage bladders of the present invention.
Figure 12:
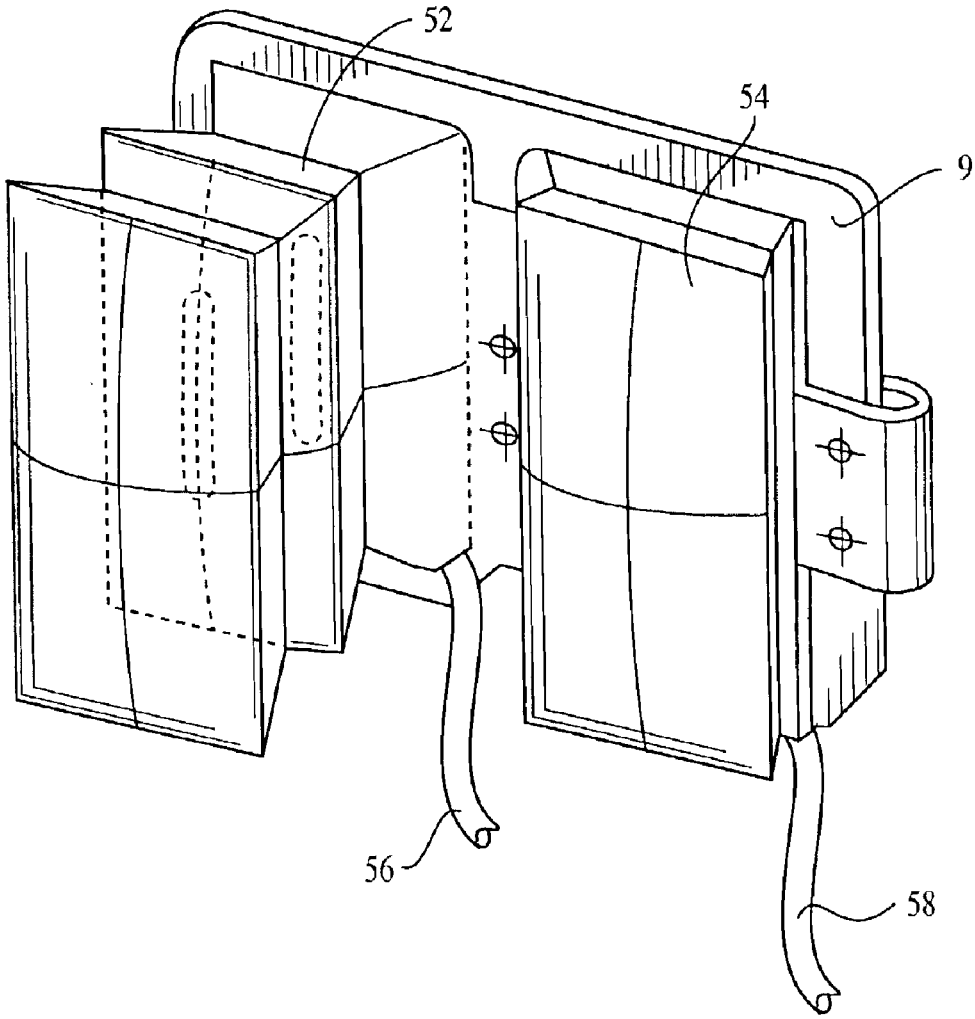
FIG. 12 shows a perspective view of the bladders shown in FIG. 11 at an instant in which the left bladder is fully inflated and the right bladder is deflated.

FIGS. 11 and 12 show a top view and a perspective view of the upper back massage package 5 of the present invention. It is seen to consist of a left 52 and a right 54, two-tiered, inflatable bladder that are connected on their back sides to an upper back, backer plate 9. Each of these bladders are connected to the exhaust ports of a fluidic by conduits 56, 58. The backer plate 9 is oriented in a seat or chair such that the cyclic inflation and deflation of these bladders alternately massages the left and the right side of one's upper back.

FIG. 12 illustrates this cycling action by showing the bladders at that instance during the cycle when the left bladder 52 is fully inflated and the right bladder 54 is deflated. The two-tiered nature of construction of these bladders is seen to be helpful in assuring that the front surfaces of these bladders can move sufficiently far forward so that they will contact the back of one who is sitting in a seat equipped with the present invention, even in the situation when the one sitting in the seat is leaning somewhat forward. These bladders 52, 54 are pressurized in a similar manner to as the lumbar massage bladders 42, 44.

Figure 13:
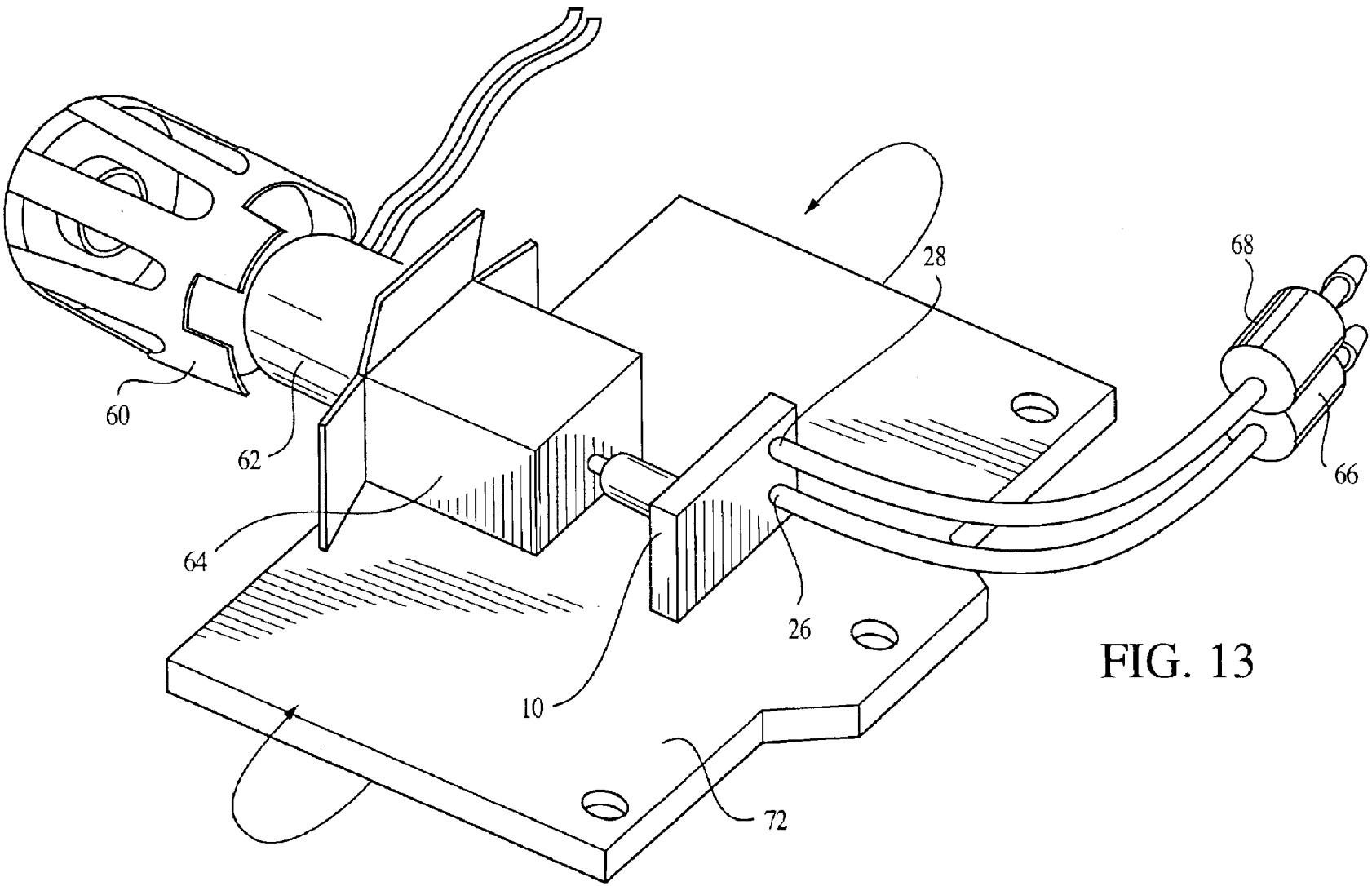
FIG. 13 shows a perspective view of a preferred embodiment of the drive system that inflates and deflates the massage bladders of the present invention.
Figure 14:
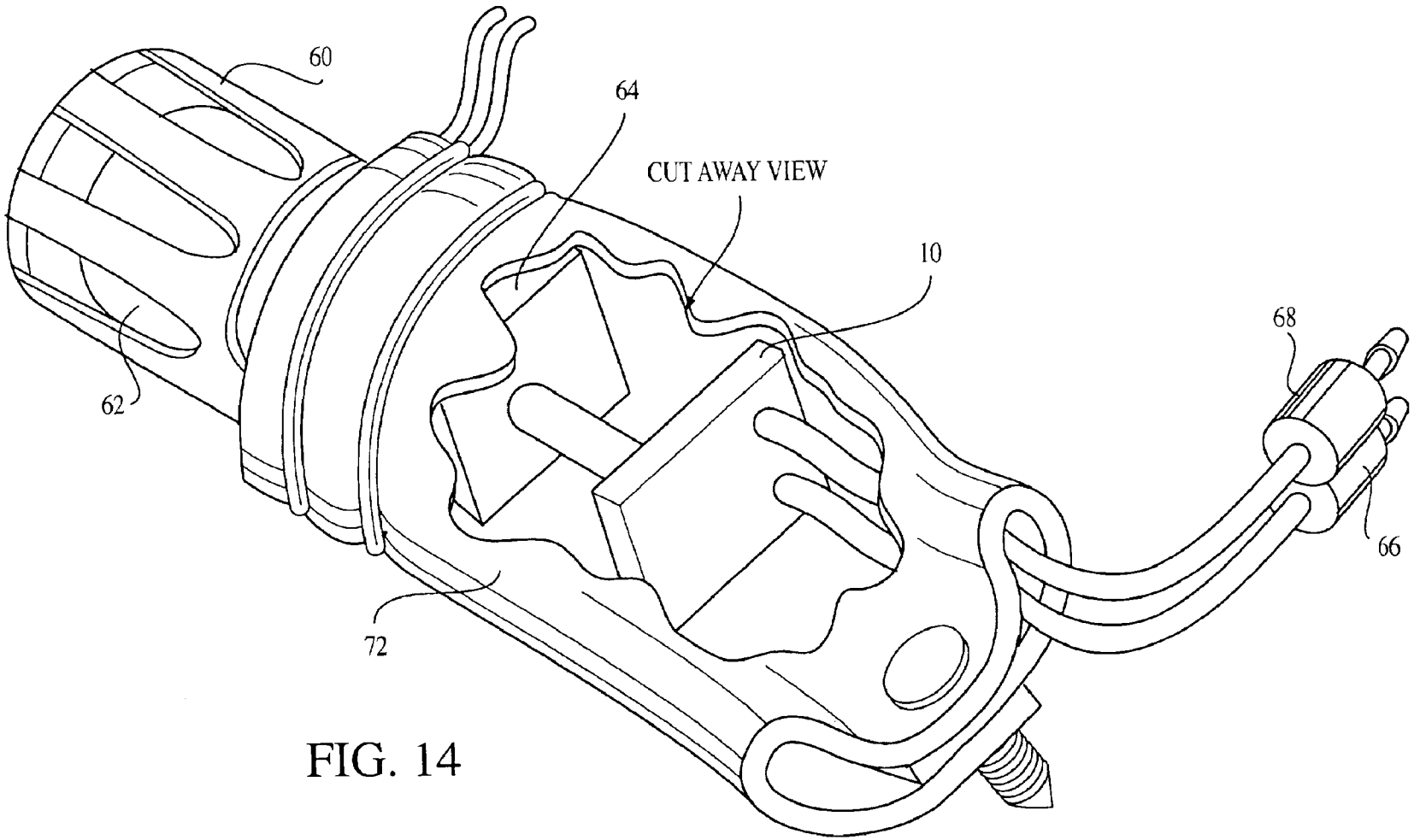
FIG. 14 shows the drive system of FIG. 13 after it has been covered with a sheet of foam material.

FIGS. 13 and 14 show the type of drive system 3, 6 that operates both of the massage packages of the present invention. It is seen to consist of a shroud 60 that partially covers a motor 62 that drives a pump 64 which supplies pressurized air to the inlet 16 of a fluidic 10 which is used to produce the cyclical flow, as shown in FIG. 8, from the fluidic's exhaust ports.

Figure 13A:
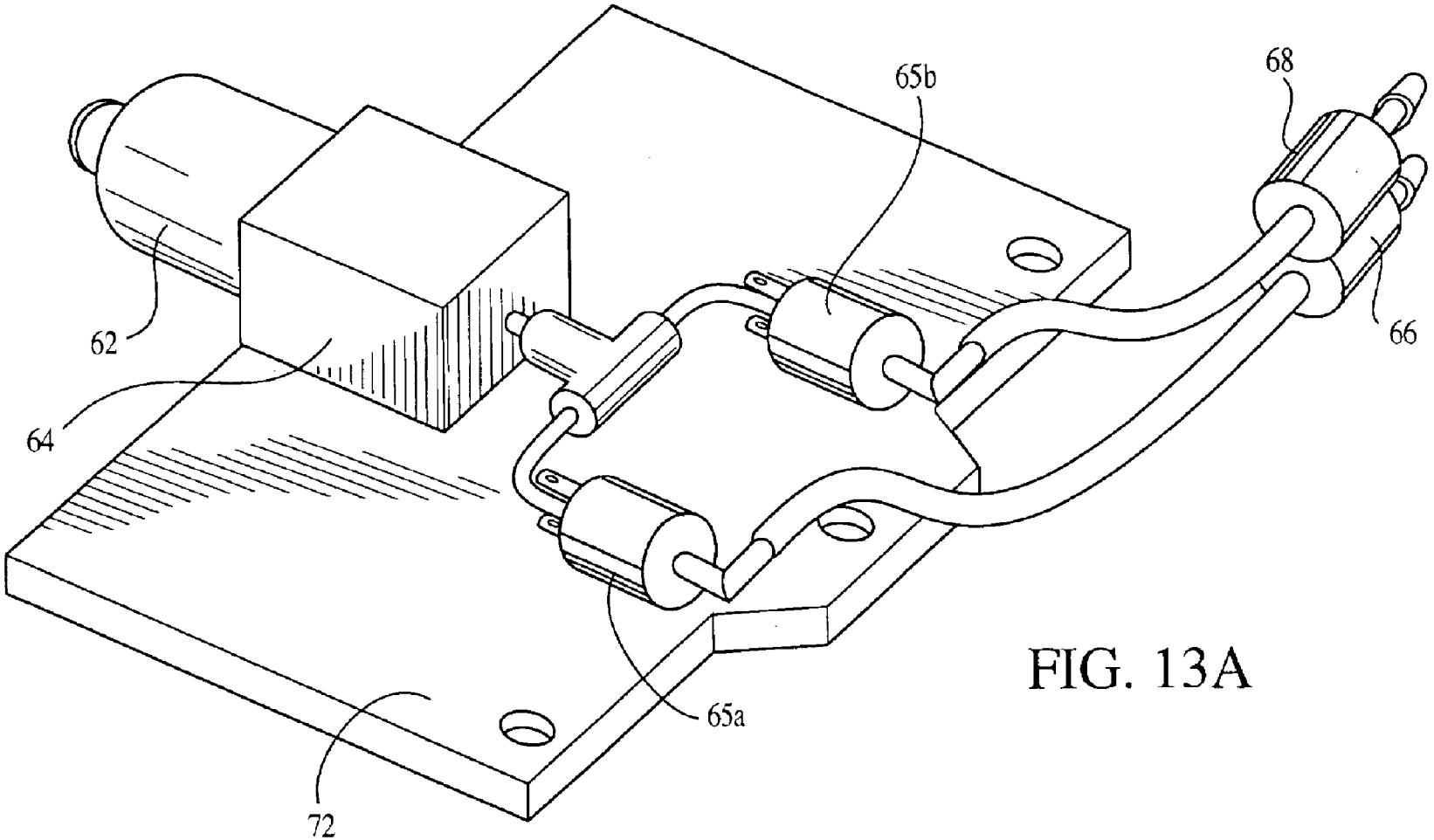
FIG. 13A shows a perspective view of another preferred embodiment of a drive system for the present invention; one which provides greater frequency control for the massage bladders.

For those applications in which one might wish to have the massage bladders operate at a frequency that cannot be conveniently provided by a simple fluidic or in which some variability is desired in setting the bladders' operating frequency, the substitute drive system shown in FIG. 13A can be used. It consists of a motor 62 that drives a pump 64 which supplies pressurized air to both of two multi-position solenoid switches 65*a*, 65*b* that control the flow to the bladders. By electronically controlling the opening and closing of these solenoids 65*a*, 65*b* greater frequency control is achieved.

Since it is desirable that such massagers operate as quietly as possible so as not to disturb or detract from the comfort of one sitting in a chair equipped with the present invention, special provisions have been made to minimize noise from this package. These consist of putting a muffler 66, 68 in each of the conduit lines that connect the fluidic's exhaust ports and the massage bladders. The pump 64 and the fluidic 10 are wrapped with a sheet 72 of foam material which serves to suppress any noises emanating from these elements. FIG. 14 shows how this package looks after it has been fully assembled with the foam sheet 72 wrapping the pump 64 and fluidic 10.

Figure 15:
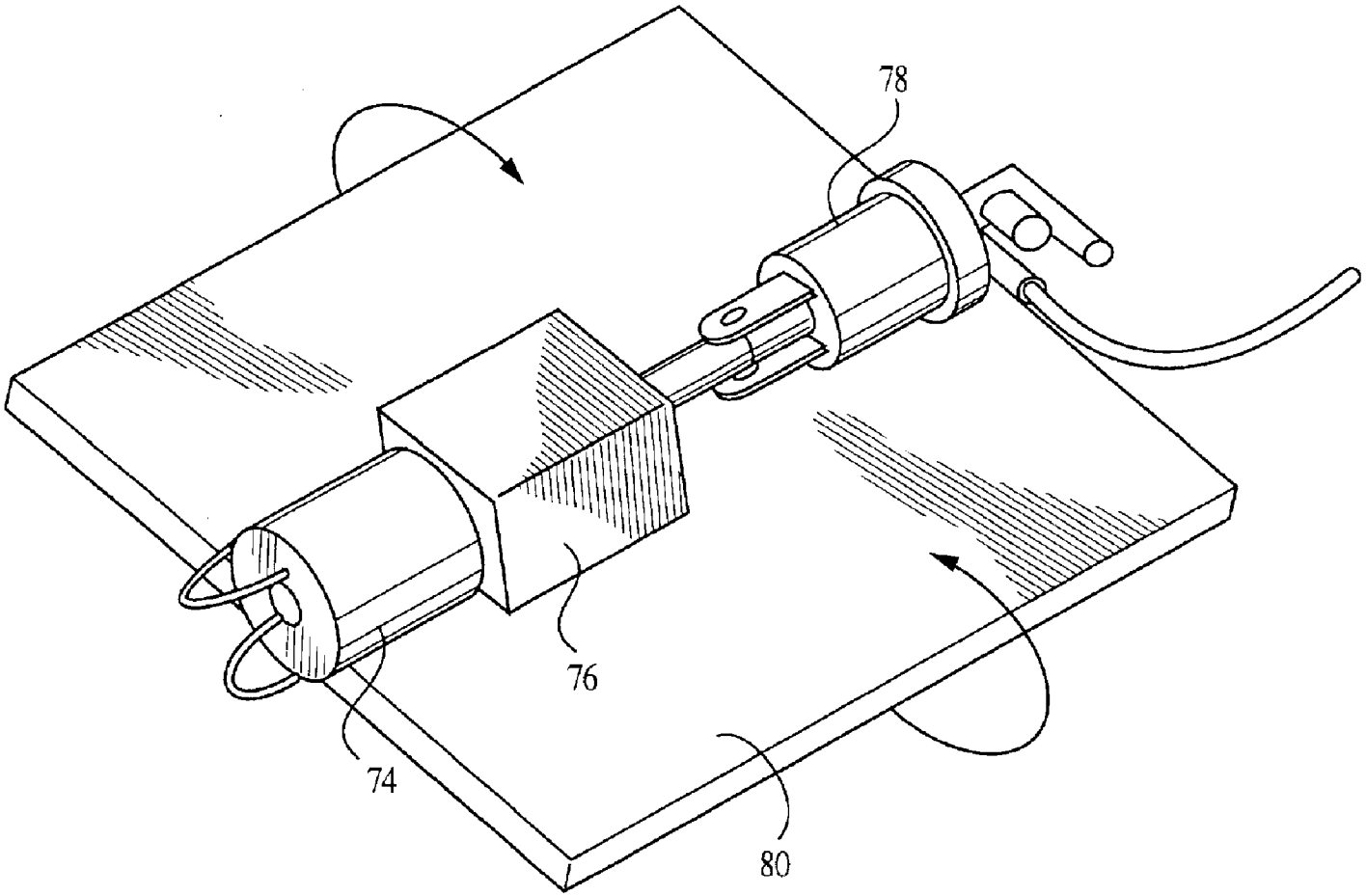
FIG. 15 shows a perspective view of a preferred embodiment of the drive system that inflates and deflates the lumbar support bladder of the present invention.
Figure 16:
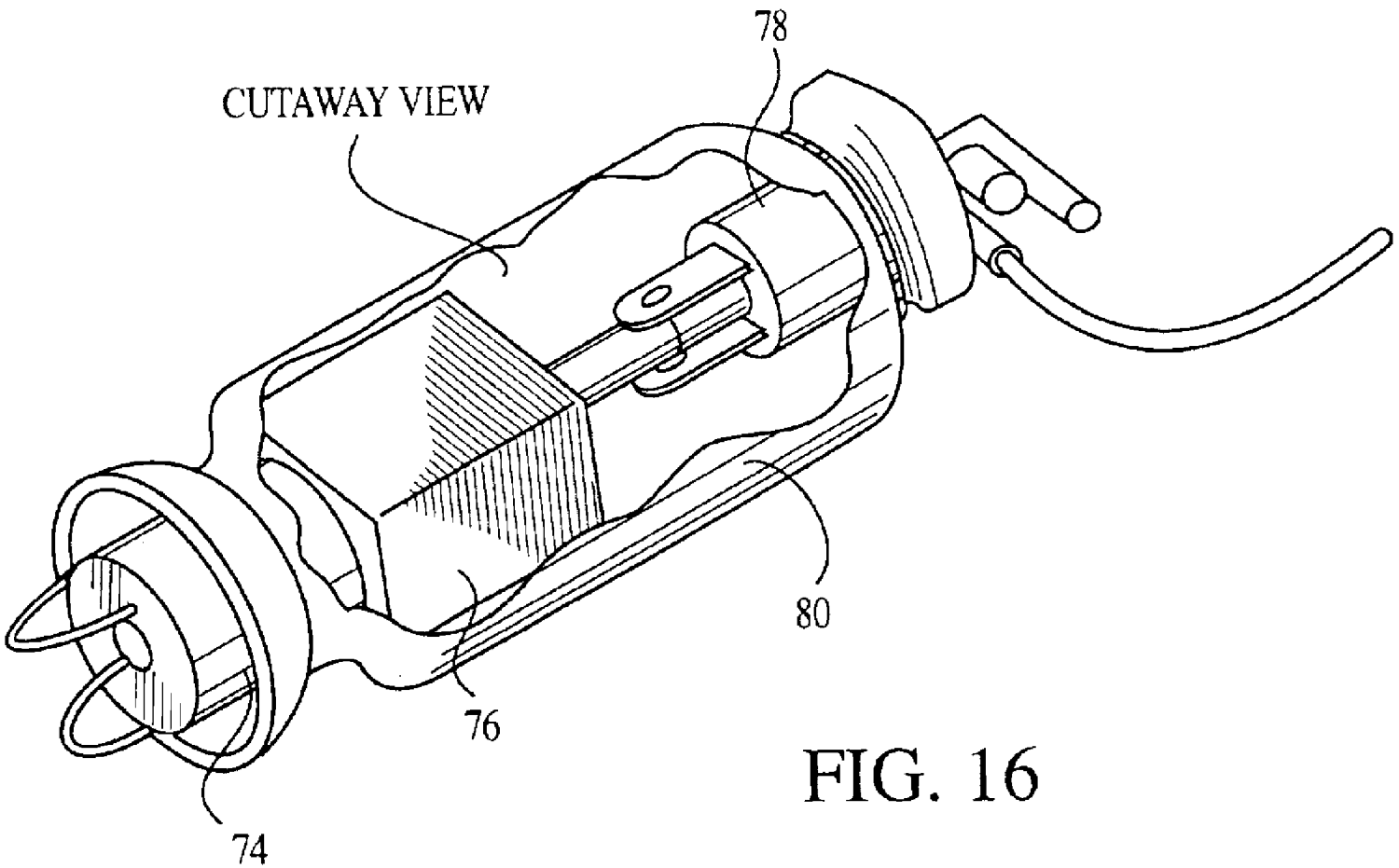
FIG. 16 shows the drive system of FIG. 15 after it has been covered with a sheet of foam material.

FIGS. 15 and 16 show the drive system 4 that operates the lumbar support portion of the lower back package of the present invention. It also consists of a motor 74 that drives a pump 76 which supplies pressurized air to a two-way, solenoid valve 78 and then to the lumbar support bladder 40. To minimize the noise from the pump 76, this combination is also wrapped with a sheet 80 of foam material.

Figure 17:
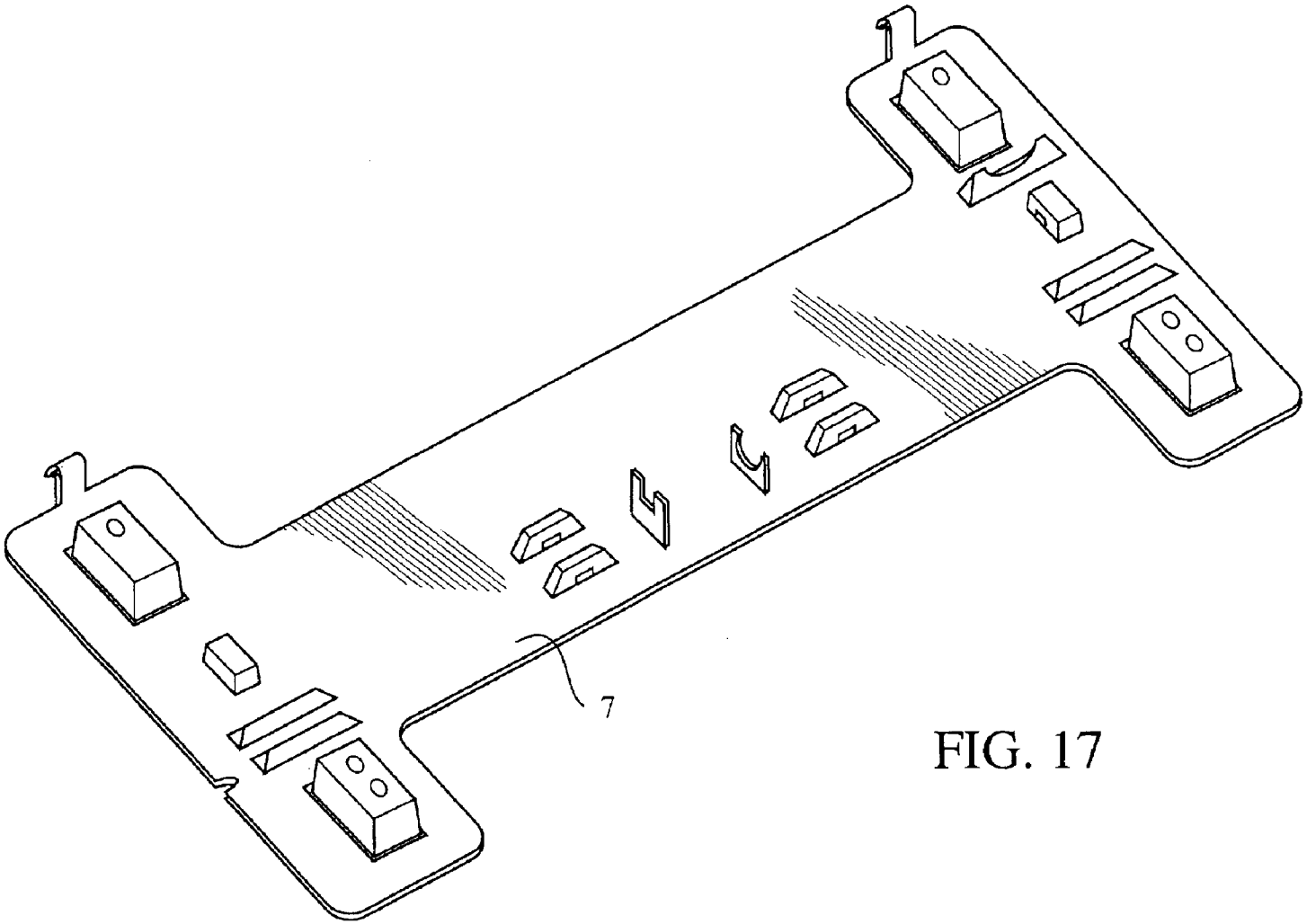
FIG. 17 a perspective view of a preferred embodiment of the carrier plate of the present invention.
Figure 18A:
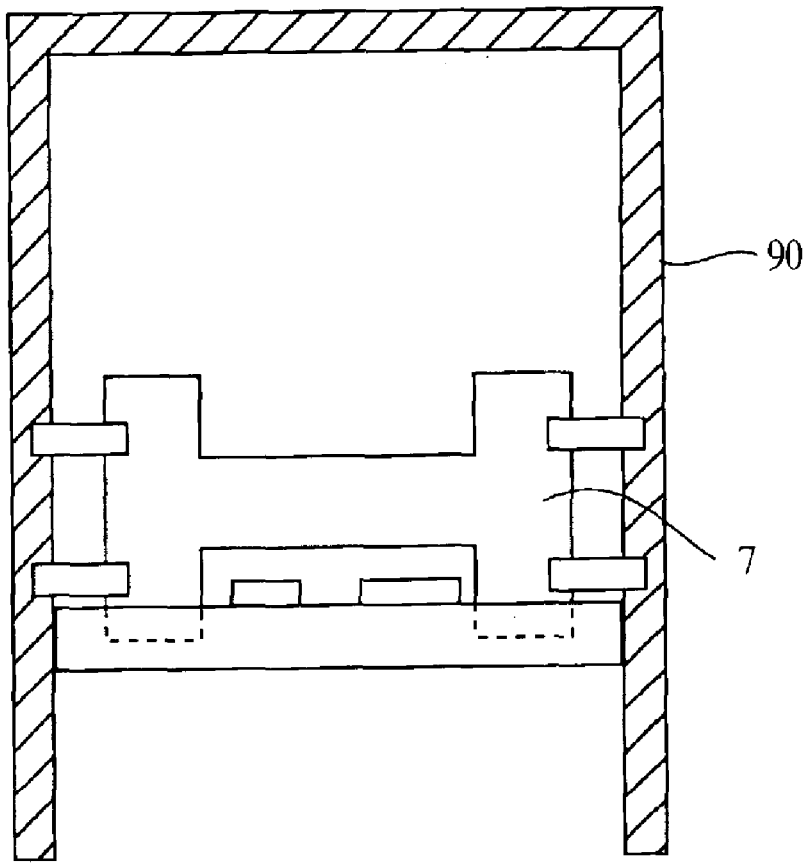
FIGS. 18(*a*)–(*b*) show a means for mounting the carrier plate of the present invention to the frame of a chair and the orientation of the bladders with respect to the carrier plate and the padding of the chair.
Figure 18B:
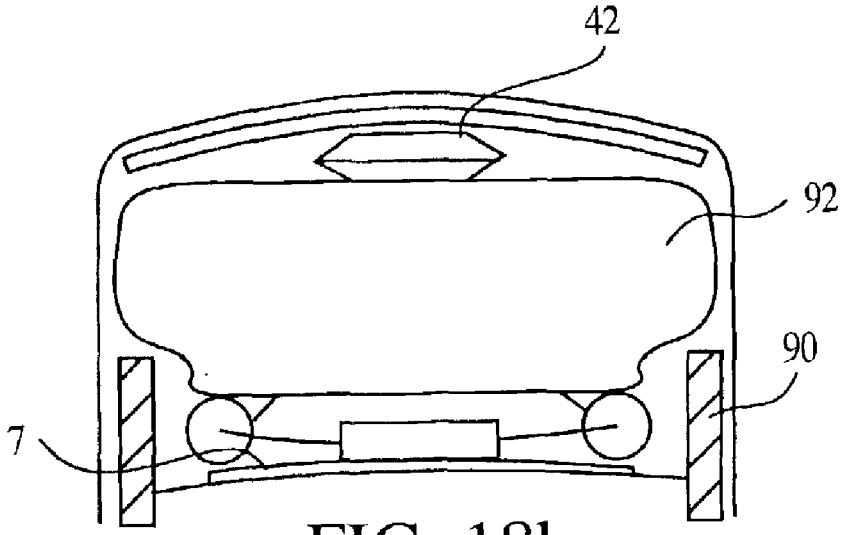

Because the various packages of the present invention have been assembled on carrier 7 or backer 8, 9 plates, it proves to be relatively easy to attach these packages to the frame of a chair or seat. FIG. 17 shows the general form of the carrier plate 7 used with the present invention. It is a molded plastic piece that contains various fixtures which aid in mounting the various elements to the plate 7. A typical means of mounting it to the frame 90 and behind the padding 92 of a chair is shown in FIGS. 18(*a*)–(*b*), with FIG. 18(*b*) also showing where the lower back bladders are oriented in the chair relative to the carrier plate 7.

Figure 19:
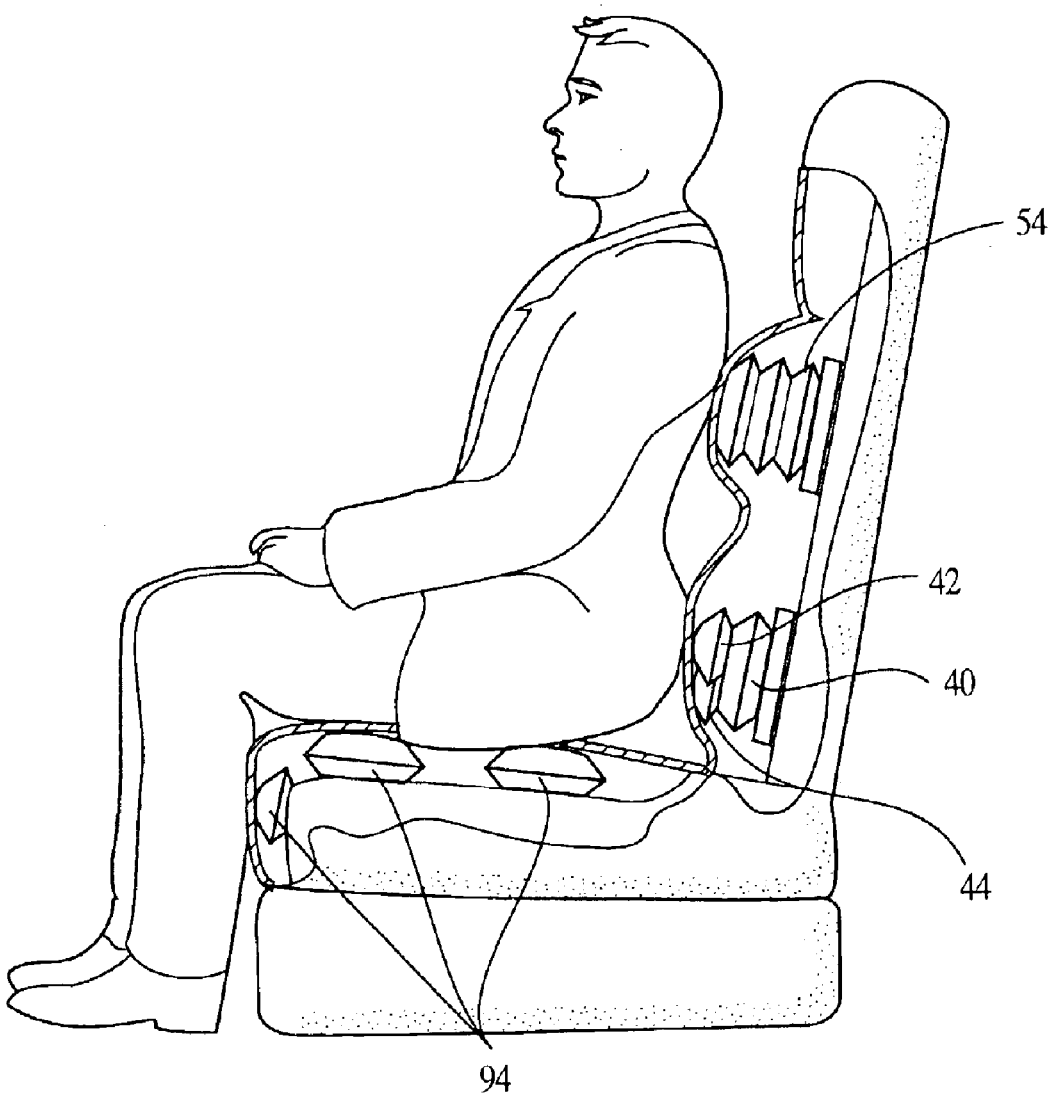
FIG. 19 shows an embodiment of the present invention in which massage bladders have been added to also massage both the backs of one's upper legs and one's calves.

While the present invention has been disclosed in relation to its use as a back massager in a seat or chair, it should be recognized that the apparatus of the present invention also can be expanded to massage other parts of the body. For example, FIG. 19 shows an embodiment of the present invention in which massage bladders 94 have been added to also massage both the backs of one's upper legs and one's calves. These bladders can be controlled to operate in unison with the other bladders 40, 42, 44, 54 or to sequentially operate so as to provide an alternative type of massage.

Figure 20A:
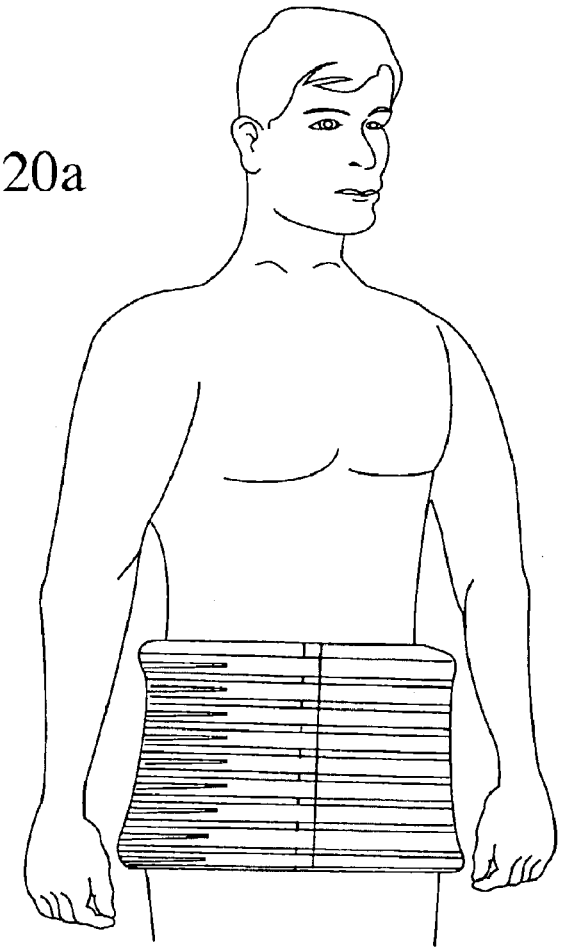
FIGS. 20(*a*)–(*b*) show preferred embodiments of the present invention in the form of massaging wraps that can be worn around the waist (a) or the leg (b).
Figure 20B:
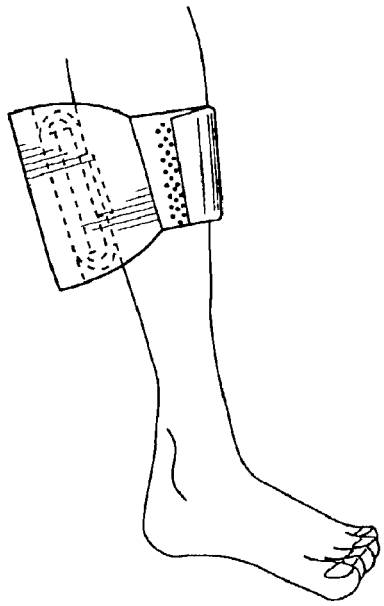

The present invention can also be used in conjunction with a horizontal surface upon which the user rests in a supine posture, as for example a bed or mattress. Additionally, various embodiments of the present invention can have their inflatable bladders so configured as to allow them to be used independent of incorporation into any type of seating or bedding product. For example, massager embodiments of the present invention can be configured so as to be used as massaging wraps which may be placed on various parts of the body, such as shown in FIG. 20.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. A method for massaging a specified area of a person, said method comprising the steps of:

providing a pair of inflatable, massage bladders configured so as to receive said specified area to be massaged, utilizing a fluid supply means to supply fluid through a conduit to said bladders, inserting a fluidic in said conduit, said fluidic having an inlet and two exhaust ports, and configuring said fluidic so as to yield alternating flow from said exhaust ports that cyclically inflates and deflates each of said bladders so as to provide a massaging sensation to said specified area, each of said bladders having a front surface, with a portion of said front surfaces being overlaid with respect to one another so as to provide a rolling massage sensation when said bladders are inflated and deflated, positioning an inflatable support bladder beneath said massage bladders, and supplying fluid to said support bladder so as to position said massage bladders in proximity to said specified area.

2. A method as recited in claim 1, further comprising the step of:

mounting said fluid supply means on a carrier plate, said plate configured so as to aid in attaching said plate to an existing means designed to support a portion of one's weight.

3. A method as recited in claim 2, further comprising the step of:

mounting said massage and support bladders on a backer plate, said backer plate configured so as to aid in holding said bladders in close proximity to said area to be massaged.

4. A method as recited in claim 3, further comprising the step of:

reducing the sound emanating from said fluid supply means by at least partially wrapping said fluid supply means in a sound absorbing means.

5. A method as recited in claim 4, wherein:

said specified area to be massaged is a person's lower back, and said carrier plate configured to be mountable in a means for allowing a person to sit.

6. A method as recited in claim 5, further comprising the step of:

providing a pair of inflatable, upper back, massage bladders configured so as to be received in close proximity to a person's upper back, utilizing a fluid supply means to supply fluid though a conduit to said upper back, massage bladders, inserting a fluid in said conduit, said fluidic having an inlet that is connected to said upper back, fluid supply means and two exhaust ports, and configuring said fluidic so as to yield alternating flow from said exhaust ports that cyclically inflates and deflates each of said upper back, massage bladders so as to provide a massaging sensation to said upper back.

7. A method as recited in claim 6, wherein:

said fluidics configured so as to provide alternating flow from said exhaust ports that cycles in the frequency range of 0.001 to 2 cycles per second.

8. A method as recited in claim 7, wherein:

said means for supplying fluid to said bladders having a pump that supplies pressurized fluid to said fluidic inlet, said fluidic configured so as to allow greater than 40% of the pressure of the fluid supplied to said fluidic inlet to be realized in said inflatable bladders.

9. An apparatus for massaging a specified area of a person, said apparatus comprising:

a pair of inflatable, massage bladders configured so as to receive said specified area to be massaged, a means for supplying fluid to said bladders, a fluidic having an inlet that is connected to said fluid supply means and two exhaust ports, a means for providing fluid flow passages that connect each of said fluidic exhaust ports to one of said air of bladders, wherein said fluidic configured so as to yield alternating flow from said exhaust ports that cyclically inflates and deflates each of said bladders so as to provide a massaging sensation to said specified area.

each of said bladders having a front surface, with a portion of said front surfaces being overlaid with respect to one another so as to provide a rolling massage sensation when said bladders are inflated and deflated, an inflatable support bladder positioned beneath said massage bladders, and a means for supplying fluid to said support bladder so as to position said massage bladders in proximity to said specified area.

10. An apparatus as recited in claim 9, further comprising:

a carrier plate on which said fluid supply means are mounted, said plate configured so as to aid in attaching said apparatus to an existing means designed to support a portion of one's weight.

11. An apparatus as recited in claim 10, further comprising:

a backer plate on which said massage and support bladders are mounted, said backer plate configured so as to aid in holding said bladders in close proximity to said area to be massaged.

12. An apparatus as recited in claim 11, further comprising:

a means for reducing the sound emanating from said fluid supply means, said sound reducing means being at least partially in close proximity to said fluid supply means.

13. An apparatus as recited in claim 12, wherein:

said specified area to be massaged is a person's lower back, and said carrier plate configured to be mountable in a means for allowing a person to sit.

14. An apparatus as recited in claim 13, further comprising:

a pair of inflatable, upper back, massage bladders configured so as to be received in close proximity to a person's upper back, a means for supplying fluid to said upper back, massage bladders, a fluidic having an inlet that is connected to said upper back, fluid supply means and two exhaust ports, a means for providing fluid flow passages that connect each of said fluidic exhaust ports to one of said pair of upper back, massage bladders, wherein said fluidic configured so as to yield alternating flow from said exhaust ports that cyclically inflates and deflates each of said upper back, massage bladders so as to provide a massaging sensation to said upper back.

15. An apparatus as recited in claim 14, wherein:

said fluidics configured so as to provide alternating flow from said exhaust ports that cycles in the frequency range of 0.001 to 2 cycles per second.

16. An apparatus as recited in claim 15, wherein:

said means for supplying fluid to said bladders having a pump that supplies pressurized fluid to said fluidic inlet, said fluidic configured so as to allow greater than 40% of the pressure of the fluid supplied to said fluidic inlet to be realized in said inflatable bladders.

17. A seat massager for massaging a user's back, said seat massager comprising:

a pair of inflatable, massage bladders configured so as to be received in close proximity to a person's back, each of said bladders having a front surface, with a portion of said front surfaces being overlaid with respect to one another so as to provide a rolling massage sensation when said bladders are inflated and deflated, a means for supplying fluid to said bladders, a fluidic having an inlet that is connected to said fluid supply means and two exhaust ports, a conduit that connects each of said fluidic exhaust ports to one of said pair of bladders, wherein said fluidic configured so as to yield alternating flow from said exhaust ports that cyclically inflates and deflates each of said bladders so as to provide a massaging sensation to a person's back, an inflatable support bladder positioned beneath said massage bladders, a means for supplying fluid to said support bladder so as to position said massage bladders in proximity to a person's back, a carrier plate on which said massage bladder and support bladder fluid supply means are mounted, said plate configured so as to aid in attaching said seat massager to the frame of a seat into which said seat massager is to be installed, and a backer plate on which said massage and support bladders are mounted, said backer plate configured so as to aid in holding said bladders in close proximity to a person's back.

18. A seat massager as recited in claim 17, wherein:

said fluidic configured so as to provide alternating flow from said exhaust ports that cycles in the frequency range of 0.001 to 2 cycles per second.

19. A seat massager as recited in claim 18, wherein:

said means for supplying fluid to said bladders having a pump that supplies pressurized fluid to said fluidic inlet, said fluidic configured so as to allow greater than 40% of the pressure of the fluid supplied to said fluidic inlet to be realized in said inflatable bladders.

20. A seat massager as recited in claim 17, further comprising:

a pair of inflatable, upper back, massage bladders configured so as to be received in close proximity to a person's upper back, a means for supplying fluid to said upper back, massage bladders, a fluidic having an inlet that is connected to said upper back, fluid supply means and two exhaust ports, a conduit that connects each of said fluidic exhaust ports to one of said pair of upper back, massage bladders, wherein said fluidic configured so as to yield alternating flow from said exhaust ports that cyclically inflates and deflates each of said upper back, massage bladders so as to provide a massaging sensation to said upper back.

21. A seat massager as recited in claim 20, wherein:

said fluidics configured so as to provide alternating flow from said exhaust ports that cycles in the frequency range of 0.001 to 2 cycles per second.

22. A seat massager as recited in claim 21, wherein:

said means for supplying fluid to said massage bladders having a pump that supplies pressurized fluid to said fluidic inlet, said fluidic configured so as to allow greater than 40% of the pressure of the fluid supplied to said fluidic inlet to be realized in said inflatable bladders.

23. An apparatus for massaging a specified area of a person, said apparatus comprising:

a pair of inflatable, massage bladders configured so as to receive said specified area to be massaged, a means for supplying fluid to said bladders, a means for regulating the inflation and deflation cycles of said massage bladders, said means being connected to said fluid supply means, a means for providing fluid flow passages that connect said regulation means to each of said pair of bladders, wherein said regulation means operates so as to inflate and deflate each of said bladders so as to provide a massaging sensation to said specified area, each of said bladders having a front surface, with portion of said front surfaces being overlaid with respect to one another so as to provide a rolling massage sensation when said bladders are inflated and deflated.

an inflatable support bladder positioned beneath said massage bladders, and a means for supplying fluid to said support bladder so as to position said massage bladders in proximity to said specified area.

24. An apparatus as recited in claim 23, further comprising:

a carrier plate on which said fluid supply means are mounted, said plate configured so as to aid in attaching said apparatus to an existing means designed to support a portion of one's weight.

25. An apparatus as recited in claim 24, further comprising:

a backer plate on which said massage and support bladders are mounted, said backer plate configured so as to aid in holding said bladders in close proximity to said area to be massaged.

26. An apparatus as recited in claim 25, further comprising:

a means for reducing the sound emanating from said fluid supply means, said sound reducing means being at least partially in close proximity to said fluid supply means.

27. An apparatus as recited in claim 26, wherein:

said specified area to be massaged is a person's lower back, and said carrier plate configured to be mountable in a means for allowing a person to sit.

28. An apparatus as recited in claim 27, further comprising:

a pair of inflatable, upper back, massage bladders configured so as to be received in close proximity to a person's upper back, a means for supplying fluid to said upper back, massage bladders, a means for regulating the inflation and deflation cycles of said upper back, massage bladders, said means being connected to said fluid supply means, a means for providing fluid flow passages that connect said regulation means to each of said pair of bladders, wherein said regulation means operates so as to cyclically inflate and deflate each of said upper back, massage bladders so as to provide a massaging sensation to said upper back.

29. An apparatus as recited in claim 28, wherein:

said regulation means being operated so as to provide alternating flow to said upper back, massage bladders so as to cycle their motion in the frequency range of 0.001 to 2 cycles per second.

* * * * *